United States Patent [19]

Cheh

[11] Patent Number: 4,461,416

[45] Date of Patent: Jul. 24, 1984

[54] METHOD AND APPARATUS FOR FEEDING LENGTHS OF ELECTRICAL WIRE AND THE LIKE

[75] Inventor: Ernest L. Cheh, Darien, Conn.

[73] Assignee: Burndy Corporation, Norwalk, Conn.

[21] Appl. No.: 305,316

[22] Filed: Sep. 24, 1981

[51] Int. Cl.[3] ..... B65H 51/10

[52] U.S. Cl. ..... 226/1; 226/108; 226/109; 226/187; 226/190; 226/191; 226/194

[58] Field of Search ..... 226/1, 108, 109, 110, 226/176, 177, 186, 187, 181, 190, 193, 194

[56] References Cited

U.S. PATENT DOCUMENTS

| | | | |
|---|---|---|---|
| 1,019,295 | 3/1912 | Bazley | 226/187 |
| 1,096,857 | 5/1914 | Pederquist | 226/187 |
| 1,135,239 | 4/1915 | Wilcox | 226/187 X |
| 1,185,260 | 5/1916 | Stine | 226/177 |
| 2,032,260 | 2/1936 | Chapman | 226/187 X |
| 2,059,089 | 10/1936 | Clesi et al. | 226/187 X |
| 2,196,647 | 4/1940 | Snyder et al. | 226/187 X |
| 3,119,536 | 1/1964 | Berkeley | 226/190 X |
| 4,235,362 | 11/1980 | Hubenko | 226/187 X |

*Primary Examiner*—Stanley N. Gilreath
*Attorney, Agent, or Firm*—Howard S. Reiter

[57] ABSTRACT

Apparatus and method for feeding a single electrical wire or a plurality of electrical wires including a feed roller means and a pressure roller means. A length of wire placed between the feed roller means and the pressure roller means is driven by the feed roller means while the pressure roller means is biased toward the material keeping the material in driving contact with the feed roller means. The pressure roller means includes means for adjusting its position automatically as the material varies in size. In the case where a plurality of lengths of wire is fed by the feed roll means, each length of wire has its own pressure roller means which independently adjusts itself to the varying size of the material being fed thereby.

10 Claims, 4 Drawing Figures

METHOD AND APPARATUS FOR FEEDING LENGTHS OF ELECTRICAL WIRE AND THE LIKE

BACKGROUND OF THE INVENTION

This invention relates generally to the feeding of lengths of electrical wire and the like and, more particularly, to a feeding method and apparatus which maintains pressure on the wire being fed within a predetermined range regardless of variance in the actual size of the wire.

It is a conventional practice in the electrical wire lead manufacturing industry to feed a predetermined length of wire from a substantially endless supply and install electrical connectors thereon or perform other operations to manufacture a completed electrical product. An example of such an automatic manufacturing technique and apparatus is disclosed in U.S. patent application Ser. No. 207,046, entitled, "Automatic Lead Making Apparatus". filed in the names of Ernest L. Cheh, Et Al on Nov. 14, 1980. There are a multitude of other manufacturing applications beyond that disclosed in this copending patent application in which it is necessary to feed a length of material, or a plurality thereof, to work stations in a reliable and controlled manner.

One continual problem in feeding lengths of wire is that all portions of the wire are not of a uniform size. For any given nominal size of wire, the manufacturing techniques allow some range of sizes through which the actual size can vary. This problem can be acute when feeding the wire through the nip of two rollers. In this type of feeding system, the rollers must be set at some gap to insure continuous driving contact with the wire. For instance, the size of the gap between the rollers can be set equal to the smallest size of the wire and continuous feeding is assured. However, this approach creates the problem of damaging the portions of the length of wire having larger sizes. The wire tends to be compressed more greatly by the increased force placed on it as larger sizes pass through the small gap.

When electrical wire is fed in this manner, the insulation around the conductor can be damaged and the strength and durability of the both wire materials can be compromised. Depending upon the severity, the wire can be rendered unusable. When feeding a plurality of wires between the rollers, the problem is further compounded in that each length of wire is varying in size. Also, the feeding of a plurality wires normally requires a large and complex apparatus.

Accordingly, it is an object of the present invention to provide an improved feeding device for wire and the like without damaging the wire even though the size of the wire varies.

It is another object of the invention to provide a roller-type feeding means for lengths of wire and the like which applies approximately the same amount of pressure on the wire even though the size of the wire varies.

It is another object of the invention to feed a plurality of lengths of wire and the like with a feeding means which applies approximately the same amount of feeding pressure on the wire even though the size of the wire varies.

It is another object of the invention to feed different nominal sizes of wires in adjacent paths by using the same feed roller means.

It is another object of the invention to provide a compact apparatus for feeding a plurality of lengths of wire and the like.

SUMMARY OF THE INVENTION

Briefly stated, and in accordance with the present invention, there is provided a compact roller-type means for feeding a single length, or a plurality of lengths, of wire or the like. The feeding means is automatically responsive to the varying sizes of the wire being fed and applies pressure to the wire that is within a predetermined range regardless of variance in wire size. In the embodiment in which a plurality of wires is fed, the invention permits the use of a single feed roller means. The feed roller means includes a means for independently adjusting the size of the gap for the wire in the feeding means for each of the plurality of wires.

BRIEF DESCRIPTION OF THE DRAWINGS

Other objects and advantages of the invention will become apparent upon reading the following detailed description with reference to the drawings wherein.

While the present invention is herein described in connection with a preferred embodiment and associated method of use thereof, it should be understood that it is not intended to limit the invention to this embodiment and method of use. On the contrary, it is intended to cover all alternatives, modifications and equivalents as may be included within the spirit and scope of the invention as defined by the appended claims.

DETAILED DESCRIPTION OF THE INVENTION

Figure 1:
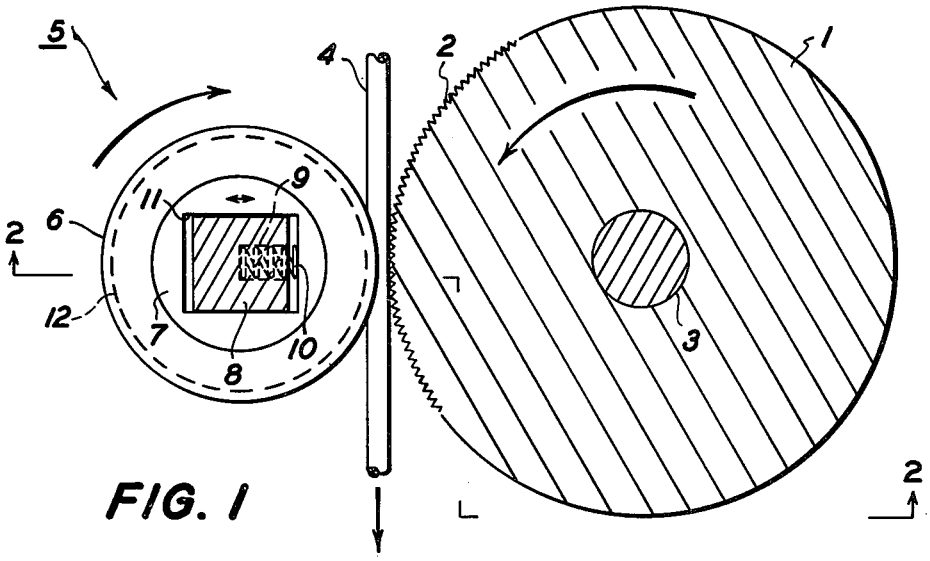
FIG. 1 illustrates a cross-sectional side view of a preferred embodiment of the roller-type feeding means.
Figure 2A:
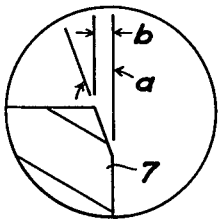
FIG. 2*a* illustrates an enlarged view of the pressure bearing member.
Figure 2:
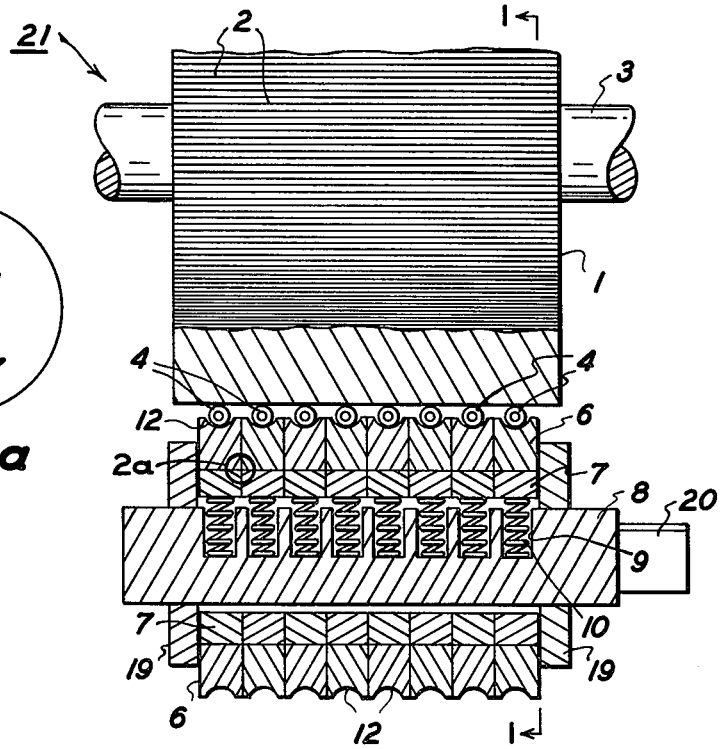
FIG. 2 illustrates a cross-sectional top view of the embodiment in FIG. 1.

Referring more particularly to the drawings, wherein like reference numerals have been used throughout to designate like elements, FIGS. 1 and 2 illustrate schematically one embodiment of the feeding means.

Referring to FIGS. 1 and 2, the apparatus contains feed roller means 21 and pressure roller means 5. Feed roller means 21 includes a feeding means, such as feed roller 1, of any suitable type for applying imparting a driving force to wire 4. The feed roller is capable of being driven by shaft 3 which is driven by any suitable driving device (not shown). The periphery of feed roller 1 is shown in this embodiment as having longitudinal grooves 2 which aid in the driving relationship with wire 4. These grooves tend to enable the feed roller to have better contact with the wire and prevent slip between itself and the wire. The feed roller need not have any particular peripheral shape or any special material on its periphery to provide the driving contact because the imparting force is basically provided for by the pressure put on the wire by the feed roller and pressure roller means 5. However, to assure uniform feeding, any suitable surface shape or material can be used. Feed roller 1 is rotated in the direction shown by the arrow.

Pressure roller means 5 can be of any suitable type that functions in the manner described below. The pressure roller means maintains the wire against the feed roller so that the combination of the two rollers feed wire 4 in the direction shown by the arrow. Pressure roller means 5 is adapted to automatically adjust the distance between the feed roller and itself in response to any variance in the size of the material being fed therebetween. Consequently, the force on wire 4 is maintained within a predetermined range ragardless of its size. This is accomplished by providing a means to move the pressure roller means relative to the feed roller means to vary the distance in accordance with the size of the wire.

Pressure roller means 5 includes an assembly of components in the embodiment shown for a self-adjusting action. Referring to FIG. 1, pressure roller 6 rides on pressure bearing member 7. Member 7 is supported by shaft 8. Shaft 8, in its operative position, is fixed relative to shaft 3 and member 7 does not rotate relative to shaft 8. Pressure roller 6 is allowed to rotate relative to member 7 and is rotated by contacting wire 4 as the wire is fed between roller 6 and feed roller 1. Member 7 is supported by pressure bearing slide surface 11 and is allowed to slide relative to shaft 8 in the direction shown by the arrow.

Shaft 8 also contains spring recesses 9 which are adapted to carry springs 10. The springs, when assembled with the shaft and pressure bearing member in the manner shown, seat at the bottom of the spring recesses and tend to bias the pressure bearing towards the feed roller. The springs bear against the side of the pressure bearing member closest to the feed roller. It is noted that the width, as best seen in FIG. 1, of pressure bearing slide surface 11 is greater than the width of shaft 8. This is to provide movement of pressure bearing 7, and thus pressure roller 6, closer to or further away from feed roller 1. As required by the size of the wire, spring 10, bearing against the side surface of pressure bearing 7, tends to keep pressure roller 6 into intimate contact with wire 4. However, if the size of the wire increases, the force of spring 10 is overcome and the pressure roller and pressure bearing member are forced to the left in FIG. 1 providing more room for a wire portion of larger size to pass between the two rollers.

As best seen in FIG. 2, there are eight individual pressure roller means in this embodiment arranged in adjacent fashion on shaft 8 next to feed roller 1. The apparatus of course, can be designed to feed any desired number of adjacent wire. Although it is not required that any special shape exist on the periphery of pressure roller 6, it can be appreciated that it may be preferable to shape the periphery in a somewhat complimentary fashion to the shape of the material being fed. As shown in FIG. 2, the cross-sectional shape or contour of the periphery of roller 6 is that of a semicircle, a little larger than the periphery of wire 4. This enables greater contact between roller 6 and the wire which provides better distribution of the force placed on the wire by roller 6.

Feed roller 1 can be made of any suitable material strong enough to provide the necessary driving force on wire 4. Likewise, pressure roller 6, pressure bearing 7 and shaft 8 can be made of any suitable material to perform the function described. Since roller 6 and bearing 7 on the one hand, and shaft 8 and bearing 7 on the other, move relative to each other, any of these materials can be made of a low friction material. In the embodiment shown herein, pressure bearing 7 is made of a bronze Oilite bearing material. "Oilite" is a trademark of Chrysler Corporation. Feed roller 1, pressure roller 6 and shaft 8 are made out of steel.

Continuing to refer to FIG. 2, it can be seen that each wire 4 in the plurality of wires is supported by a pressure roller means or assembly which acts independently of the others. Shaft 8 provides a mounting for eight separate pressure roller assemblies which are placed adjacent one another. Hubs 19 keep the pressure roller assemblies together and on a place along shaft 8 adjacent to their respective feed rollers. Shaft 8 has a key on its end is more fully described in conjunction with FIG. 3.

Each of the pressure roller assemblies acts independently upon wires 4. Even if all eight wires are of the same nominal size, there still may be significant fluctuations between any wire and its adjacent wire in terms of the actual diameter that is passing through the feeding means. For instance, a first wire may be at the lower end of its manufacturing tolerance whereas the adjacent wire may be at the high end of its manufacturing tolerance. It is a feature of the invention that the pressure roller assemblies self-adjust on an individual basis relative to the size of the wires without any influence whatsoever from adjacent pressure roller assemblies. In this manner, a single feed roller may be used to drive a plurality of wires while the individual pressure roller means are self-adjusting to provide approximately the same amount of pressure on each wire as it passes between the two rollers.

FIG. 2*a* is a blown up view of pressure bearing member 7 in the vicinity of where it interacts with pressure roller 6. The pressure bearing member is recessed to a suitable distance "b" where it contacts the pressure roller 6 due to an angle "a" on the side of pressure bearing 7. This assures that each pressure bearing member 7 only acts on its respective pressure roller 6. If there should be some sideway translation on either roller 6 or bearing 7, the recess prevents bearing 7 from interacting with any adjacent roller. Thus, each member 7 bears only on its related pressure roller 6 under all operating conditions.

As wire is fed through feed roller 1 and pressure roller 6 in any of the eight assemblies shown in FIG. 2, the force on the wire is always maintained within a predetermined range. The range of force may vary from feeding situation to situation and is a function of wire size, strength of the wire, speed at which feed takes place and other factors. The amount of force depends upon the strength of spring 10. The force distribution on the pressure roller side of the wire is to some extent dependent upon the shape of peripheral contours 12. By choosing appropriate parameters for these aspects of the apparatus, it can be assured that the feeding system operates in a prescribed manner. A positive uniform feeding of wire is carried out while avoiding any possible damage to the wire due to variance in size of the wire.

For instance, if No. 22 electrical wire were to be fed by the apparatus, the nominal size of this wire is 0.062 inches in diameter. However, the manufacturer's standard tolerance for this wire is between 0.057 inches and 0.067 inches. The pressure roller assembly described herein provides for automatic self-adjustment of the pressure roller means to apply an approximately constant force on the wire all through its possible range of sizes. As the 0.057 inches or minimum side of the range is fed through the gap, pressure roller 6 is forced towards feed roller 1 to assure positive contact between the rollers and the wire for feeding. On the other hand, if the diameter of the wire approaches the higher side of the range to 0.067 inches, the pressure roller 6 moves to the left to open up the gap between the two rollers to provide room for the larger diameter section of the wire to pass through. By maintaining pressure on the wire through roller 1 and roller 6, damage to the wire is avoided. The force ultimately placed on roller 6 by spring 10 would be distributed over a fairly broad peripheral portion of wire 4 by periphery contours 12.

Continuing to refer to FIG. 2, the independent action of each pressure roller assembly 5 enables the apparatus to simultaneously feed eight wires by a single feed roller. Each pressure roller assembly varies its gap relationship to the feed roller depending upon the actual size of the wire portion being fed therebetween. The wire can be fed from any suitable source such as a supply reel, each of the eight lengths having its individual supply. Even if all of the reels are feeding wire of the same nominal size, there is likely to be variance in the actual size of each wire along its length as well as between the different supply reels. In one length of wire, the actual size may be at the lower end of its size range, whereas, in the adjacent wire, the actual size of the wire may be in the higher end of its size range. If the pressure roller assemblies did not act independently, the wire with the larger actual diameter would be more compressed than the one at the lower end of the range. Without such independent action, a uniform force, and driving contact, could not be maintained between the pressure bearing rollers and the feed rollers.

Figure 3:
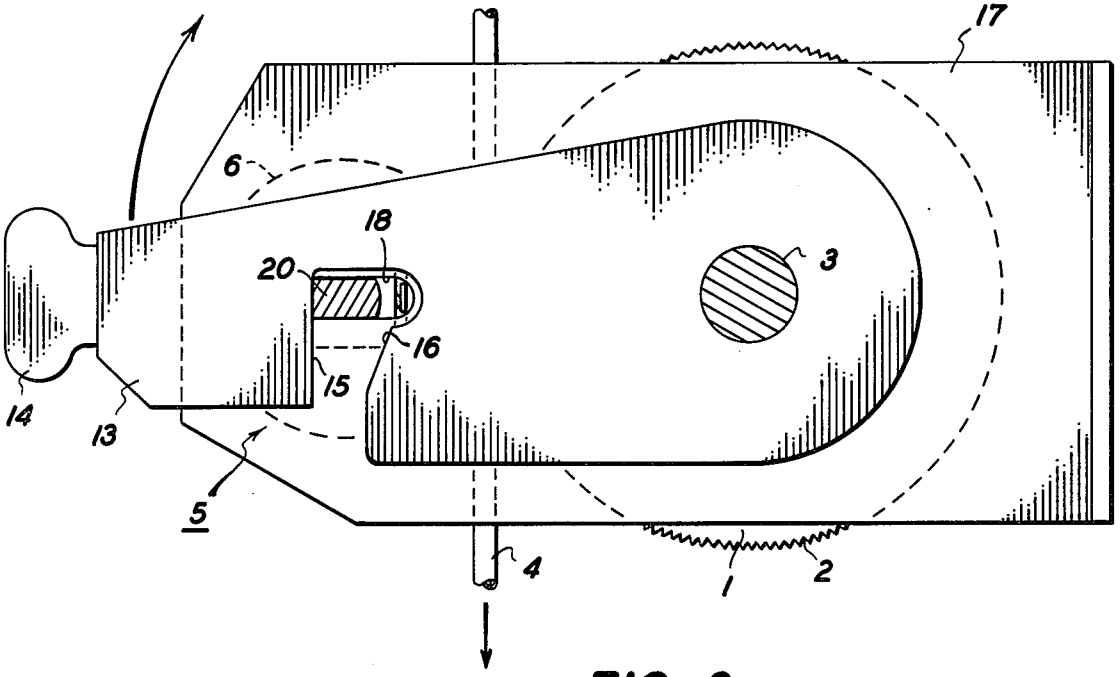
FIG. 3 illustrates a side view of the apparatus for disengaging and engaging the feed roller means and pressure roller means.

FIG. 3 shows a mechanism for placing the pressure roller means into operative position with the wire and feed roller and for removing the pressure roller means to an inoperative position wherein feeding does not take place. The inoperative position is utilized to feed new lengths of wire into the feeder, to perform maintenance, etc. The mechanism is illustrated in its operating position wherein wire 4 lies between pressure roller 6 and feed roller 1 with the feed roller providing driving force to the wire. Shaft key 20 keeps shaft 8 in its operative position by virtue of locking surface 15 on cam latching lever 13. Key 20 is in its closest position to shaft 3 while in its operative position. Frame 17 contains slot 18 within which shaft key 20 is able to move. Cam latching lever 13 is mounted coincident with shaft 3.

Handle 14, located at the end of the lever allows an operator to move lever 13 in a clockwise direction, as shown by the arrow, to bring the pressure bearing means 6 into the inoperative position. The operator pushes upward on handle 14 causing lever 13 to move in a clockwise direction. As lever 13 moves up, release surface 16 on the lever moves up and pushes against the right side of shaft key 20. At the same time, locking surface 15 of lever 13 clears the left side of key 20 allowing release surface 16 to push the key and the entire pressure roller means assembly to the left disengaging the pressure roller means from the wire.

To re-engage the pressure roller means back into operative position, the operator merely reverses the process and moves handle 14 in a downward direction which thereby causes lever 13 to move in a counterclockwise direction. As this is done, locking surface 15 bears against the left side of key 20 pushing it into engagement with the wire.

The foregoing describes one embodiment of a compact feeding apparatus. It should be mentioned that although the feeding of conventional electrical wire is described above, any other type of suitable material can be fed. For instance, other substantially cylindrical materials can be fed equally as well. In addition, materials of cross-sectional shape other than cylindrical can be used with the feeding means. Further, ribbon-type electrical wire can be fed by the invention.

It can also be appreciated that it is possible to use the apparatus described above with different nominal sizes of wire. For instance, all eight substantially endless lengths of wire need not be all the same nominal size. The spring 10 and periphery seats 12 can be so selected that varying nominal sizes of wire can be fed adjacent each other in the apparatus as the operator determines and still provide a prescribed feeding force on each wire even though the diameters are substantially different. This provides great flexibility to the feeding apparatus and eliminates unnecessary changeover of the feeding system between jobs. The device described herein is a very compact mechanism for accomplishing this result.

It should be understood that the foregoing description is only illustrative of the invention. Various alternatives and modifications in the structural and functional features of the feed means can be devised by those skilled in the art without departing from the invention. Accordingly, the present invention is intended to embrace all such alternatives, modifications and variations which fall within the spirit and scope of the appended claims.

What is claimed is:

1. Apparatus for feeding a length of material such as wire or the like comprising:

(a) feed roller means, (b) means for driving the feed roller means to impart a driving force on the material, and (c) pressure roller means for maintaining the material against the feed roller means, (d) said pressure roller means incorporating adjusting means located within said pressure roller means for moving the pressure roller means relative to the feed roller means and for continuously biasing the pressure roller means towards the feed roller means, said adjusting means serving to adjust automatically the distance between the pressure roller means and the feed roller means in response to variance in the size of the material being fed while maintaining the force exerted on the material between the feed roller means and the pressure roller means within a predetermined range regardless of the size of the material therebetween.

2. The apparatus as in claim 1 wherein the pressure roller means includes a pressure roller which contacts the material being fed, shaft means and means for supporting the pressure roller for rotation relative to the shaft means while in contact with the material.

3. The apparatus as in claim 2 wherein said adjusting means comprises said means for supporting the pressure roller for rotation and means for biasing the pressure roller in the direction of the feed roller means.

4. The apparatus as in claim 3 wherein the means for supporting the pressure roller for rotation is a pressure bearing means and the means for biasing includes a spring means interacting between the shaft means and pressure bearing means.

5. The apparatus as in claim 4 wherein the pressure bearing means or the pressure roller means is made of a low friction substance.

6. The apparatus as in claim 1 wherein the pressure roller means is in contact with the material and has a peripheral contour adapted to approximate the contour of that portion of the material with which it has contact.

7. The apparatus as in claim 1 wherein the feed roller means is in contact with the material and has a peripheral surface adapted to readily impart a driving force to the material.

8. An apparatus for feeding a plurality of lengths of material such as wire or the like comprising:

(a) feed roller means, (b) means for driving the feed roller means to impart a driving force on the plurality of lengths of material, and (c) a plurality of pressure roller means, each pressure roller means for maintaining a respective length of material against the feed roller means, (d) each said pressure roller means incorporating adjusting means located within said pressure roller means for independently adjusting each said pressure roller means relative to the feed roller means and for independently biasing each said pressure roller means continuously towards the feed roller means, said adjusting means of each said pressure roller means serving to adjust automatically and independently the distance between that pressure roller means and the feed roller means in response to variance in the size of the material being fed between that pressure roller means and the feed roller means while maintaining the force exerted on each length of material between the feed roller and pressure roller means within a predetermined range regardless of the size of the material therebetween.

9. Apparatus for feeding a plurality of lengths of material such as wire or the like comprising:

(a) feed roller means having a peripheral surface with grooves or the like thereon for engaging the plurality of lengths of material, (b) means for driving the feed roller means to impart a driving force on the plurality lengths of material, (c) a plurality of pressure roller, each for maintaining a respective length of material in the plurality against the feed roller means, the pressure roller means each having means for being supported for rotation on a pressure bearing means, (d) means for adjusting the distance between the feed roller means and each pressure roller means independently and automatically in response to variance in the size of any of the lengths of material in the plurality being fed, said adjusting means being located within the pressure bearing means, (e) shaft means for supporting the pressure bearing means, and (f) biasing means located within the pressure bearing means and interacting between the shaft means and the pressure bearing means for continuously biasing the pressure roller means towards the feed roller means and maintaining the force exerted on the material between the pressure roller means and the feed roller means within a predetermined range regardless of the size of the size of the material therebetween.

10. Method of feeding a plurality of lengths of material such as wire and the like comprising:

(a) engaging a portion of each length of material between a feed roller means and a pressure roller means, (b) imparting a feeding force to the plurality of lengths of material by the feed roller means, (c) continuously maintaining a portion of the pressure roller means against each length of material, and (d) automatically adjusting the force placed by the pressure roller means against each length of material by biasing the pressure roller means towards the feed roller means from within so that the force on each length of material is maintained in a predetermined range.

* * * * *